United States Patent [19]

Richardson

[11] 4,283,729

[45] Aug. 11, 1981

[54] MULTIPLE BEAM ANTENNA FEED

[75] Inventor: Phillip N. Richardson, Dallas, Tex.

[73] Assignee: Texas Instruments Incorporated, Dallas, Tex.

[21] Appl. No.: 106,774

[22] Filed: Dec. 26, 1979

[51] Int. Cl.[3] ..... H01Q 3/26

[52] U.S. Cl. ..... 343/854; 343/100 LE

[58] Field of Search ..... 343/853, 854, 100 SA, 343/100 LE

[56] References Cited

U.S. PATENT DOCUMENTS

| | | | |
|---|---|---|---|
| 3,276,018 | 9/1966 | Butler | 343/854 |
| 3,631,503 | 12/1971 | Tang | 343/854 |
| 4,124,852 | 11/1978 | Steudel | 343/854 |

*Primary Examiner*—Eli Lieberman

*Attorney, Agent, or Firm*—Rene' E. Grossman; Melvin Sharp; James T. Comfort

[57] ABSTRACT

An open array antenna having a plurality of columns of radiating elements and a feed network, said feed network having a sum channel, a difference channel, and a sidelobe suppression channel formed in common in an input power divider and first, second, third and fourth power dividers, said power dividers connected in a corporate arrangement for providing equal length paths of minimum length to the columns of radiating elements, said power dividers comprising a plurality of hybrids having preselected coupling ratios and interconnections to form the input power divider with input ports for sum, difference, and SLS RF power, and to output sum, difference, difference minus sum, and SLS amplitudes to the first and second power dividers, and sum, difference and SLS amplitudes to the third and fourth power dividers, the hybrids of the first and second power dividers forming tapered sum and SLS amplitudes and forming tapered difference power by selectively combining the difference minus sum amplitudes to the difference amplitudes as a control for the difference amplitudes to provide power for a difference pattern which is independent of the amplitudes for the sum and SLS pattern excitations for a preselected number of the columns of radiating elements and the hybrids of the third and fourth power dividers forming substantially independent tapered sum, difference, and SLS amplitude excitations for the remaining columns of radiating elements, said sum, difference and SLS amplitude excitations of the columns of radiating elements combining to form sum, difference, and SLS beam patterns.

14 Claims, 14 Drawing Figures

NOTES:

1. ALL RESISTOR VALUES ARE IN OHMS. UNLESS OTHERWISE NOTED, ALL RESISTORS ARE 1/4 WATT.
2. RESISTORS R1 AND R2 ARE EXTERNAL 50-OHM COAXIAL TERMINATIONS.

NOTES:
1. ALL RESISTORS ARE EXTERNAL 50-OHM, 1/2 WATT COAXIAL TERMINATIONS.
2. RESISTORS ARE CONNECTED TO EXTERNAL SMA JACKS; REFERENCE DESIGNATORS ARE SHOWN BELOW RESISTOR NUMBERS.

223231

MULTIPLE BEAM ANTENNA FEED

This invention relates to radar antennas and more particularly to a feed network for an antenna for the air traffic control radar beacon system.

In the past, multiple beam array antennas for radars have included feed networks utilizing hybrid matrices to form only sum and difference beams.

Some of these arrays have employed equal-path-length feed matrices with the powder dividers located near the antenna's radiating elements, so that the array has good frequency bandwidth (due to equal line-lengths) and minimum transmission line loss (since the power dividers are located near to the radiating elements, to minimize line length. These feed networks have been designed and optimized to give good sum pattern performance, but the difference pattern was formed by hybrids which feed only half-sections or quarter-sections of the array in phase opposition. The result was difference patterns which had objectionable high sidelobes.

Other prior-art feed networks were capable of independently optimizing the sum and difference for low sidelobes in both patterns, but these networks utilized a single matrix which had to be located near the center of the antenna array. Thus, the network had long feed lines connecting the power to the outer array elements. Accordingly this hybrid matrix was objectionable in that it was huge in size, heavy in weight and had excessive transmission line loss.

Other feed networks, such as the Blass matrix, are serial in design; that is, the feed lines are not of equal length. Because of its serial nature, some outputs of the Blass matrix are linked to the input by only a few hybrid couplers, while other outputs are linked through many couplers. This causes phase dispersion among the outputs, since each output path contains a different number of couplers and a different length of transmission line. This phase dispersion results in limited frequency bandwidth.

An improved version of the Blass matrix employs added transmission line length at the outputs of some ports to equalize the path lengths of the outputs, partially eliminating the phase dispersion. Dispersion resulting from the unequal number of hybrid couplers is not corrected, however, and the addition of this output transmission line length causes increased attenuation (signal loss) in the network. Also, for Blass matrices implemented in stripline transmission line, small dielectric-constant variations in the stripline substrate can result in intolerable phase errors at the outputs, which must be individually hand-corrected for each network manufactured.

It is an object of this invention to provide a feedline matrix capable of forming independently optimized sum and difference patterns for an array antenna such as an air traffic control radar beacon system open array antenna.

Another object of the invention is to provide a hybrid matrix which can form a maximum number of arbitrary orthogonal beams.

Still another object of the invention is to provide a hybrid matrix which can be located closer to the elements being fed, to minimize transmission line loss.

Yet another object of the invention is to provide a hybrid matrix suitable for stripline implementation.

A further object of the invention is to provide a hybrid matrix which can be fabricated in single layer stripline or in wave guide.

Briefly stated, the invention comprises an array antenna having a multiple beam antenna feed network providing equal time delay to all outputs for independent, optimized sum ($\Sigma$) and difference ($\Delta$) beams. A corporate-feed arrangement of cables and power dividers feed the radiating elements. The power dividers, utilizing orthogonal principles to achieve independent beams, provide a sum power divider network to form the optimized $\Sigma$ phase and amplitude distribution for the full array. The sum power divider network is comprised of four-port hybrid couplers, and is arranged so that each hybrid feeds adjacent pairs or groups of elements in the array. Thus the network can be segmented so that the hybrids can be located very near the radiating elements, to minimize both the length and number of coaxial cables or other transmission hybrids and radiating elements. By injecting additional signals into the fourth ports (difference arms) of the four-port hybrids used in this network, the power division ratios within the network can be altered to form other distributions—in this case an independently optimized difference pattern and a sidelobe suppression pattern.

Although the example of the invention which is described in detail subsequently in this disclosure is configured for three independently-optimized beams (called sum, difference, and sidelobe-suppression) the invention can also be used to form other beam shapes and larger numbers of beams. In an array antenna having N radiating elements, it is theoretically possible to form N independent, isolated radiation patterns. The network described herein provides a practical means for implementing any number of these theoretically possible beams using low-loss, broad-band microwave circuitry. The set of beams which are formed will, in every case, meet the criterion of orthogonality, which implies that each beam is formed without any compromises in gain, pattern shape, isolated, or other performance criteria for the other beams in the set.

The novel features believed to be characteristic of this invention are set forth in the appended claims. The invention itself, however, as well as other objects and advantages thereof may best be understood by reference to the following detailed description of an illustrative embodiment when read in conjunction with the accompanying drawings in which:

Figure 1:
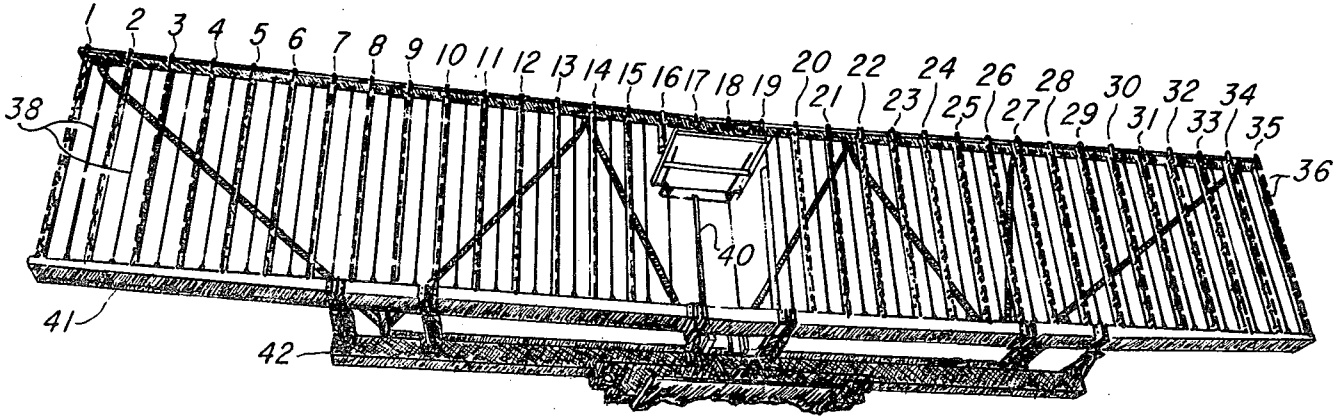
FIG. 1 is an isometric view of an air traffic control radar beacon system antenna.

Before further describing the invention, the phase-/amplitude distributions required for independently optimized low-sidelobe sum and difference patterns in an array will be briefly discussed. A low-sidelobe sum pattern in an array is formed by exciting all radiating elements in the array in an in-phase condition, and further by exciting the central elements in the array at a higher level than the edge elements, and tapering the element amplitudes from the center to the edge of the array in a smooth manner.

In a somewhat similar manner, a low-sidelobe difference pattern is formed by feeding one-half of the array out-of-phase with the other half. (Within either half, all of the elements are in-phase) Further, the center elements of each half are fed at a greater amplitude than the edges of each half, and the element amplitudes smoothly taper from a high level at the center of the halves to a low level at the edges of the halves. The amplitude taper for the two halves are mirror-images. Note, therefore, that the center of the array must be at a low level for the difference pattern, contrasted with a high level at the center for the sum pattern.

Also before proceeding further with a discussion of the invention, certain properties of the four-port microwave hybrid will be summarized. Each four-port hybrid power divider is characterized by a coupling ratio K: If a voltage $V_\Sigma$ is applied to the sum input, it is divided between the two outputs in the ratio $(K/(1-K^2)^{\frac{1}{2}}$.

The value of K for such hybrid is selected to divide the input voltage in the correct ratio among the array elements to yield the desired sum amplitude distribution. The value of K is determined by the physical dimensions of the hybrid, and once K is fixed in building the hybrid, it cannot be changed.

If a voltage $V_\Delta$ is applied to the fourth port (the difference port) of the hybrid, it divides among the two outputs in the ratio: $-(1-K^2)^{\frac{1}{2}}/K$. Note that this is the reciprocal of the ratio at the sum input, and note also the minus sign, indicating that the two outputs are 180 degrees apart in phase.

The two inputs of the hybrids (the sum and difference ports) are completely isolated from—and independent of—each other. No power can flow between two ports. If voltage $V_\Sigma$ and $V_\Delta$ are applied to the hybrid simultaneously, the output voltages are simply the algebraic sum of the voltages which result from $V_\Sigma$ alone and from $V_\Delta$ alone.

Returning now to the operation of the invention, an optimized low-sidelobe difference distribution for the array requires feeding adjacent elements in the array in different amplitude ratios than those which are optimum for the sum distribution. The coupling ratios K for the hybrids were chosen to give the optimum sum distribution, and are therefore not correct for the difference distribution. Since the value of K is fixed by the hybrid's construction, the sum port of the hybrid is obviously not a suitable input for the difference pattern. The other potential input port, the difference arm of the hybrid, is also unsuitable as an input port because its outputs are out-of-phase. As stated above, adjacent elements in either half of the array must be in-phase for the difference distribution. Further, the amplitude division ratio for the difference input is fixed at the reciprocal of the sum ratio and cannot be varied to independently optimize the difference pattern.

Figure 8:
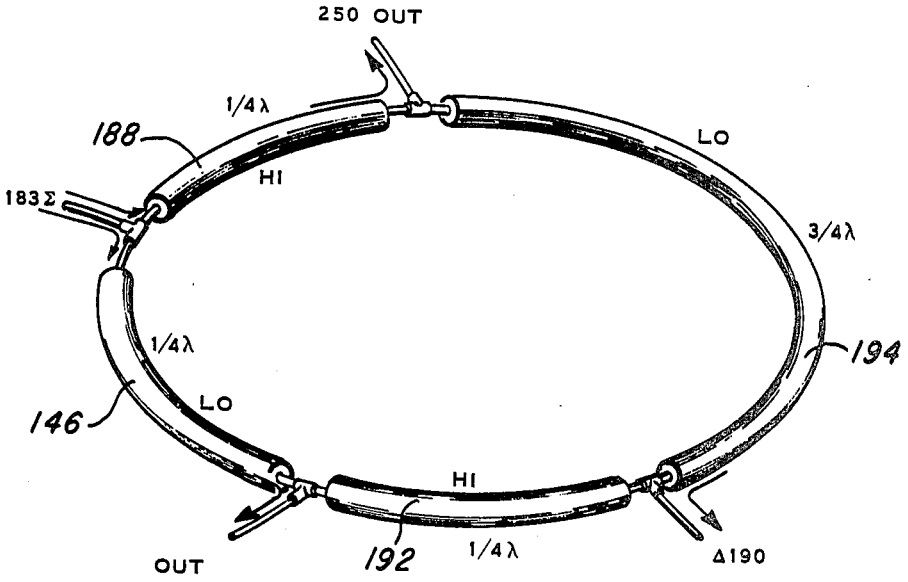
FIG. 8 is a schematic diagram of the four-port hybrid utilized in the multiple beam feed network.
Figure 14:
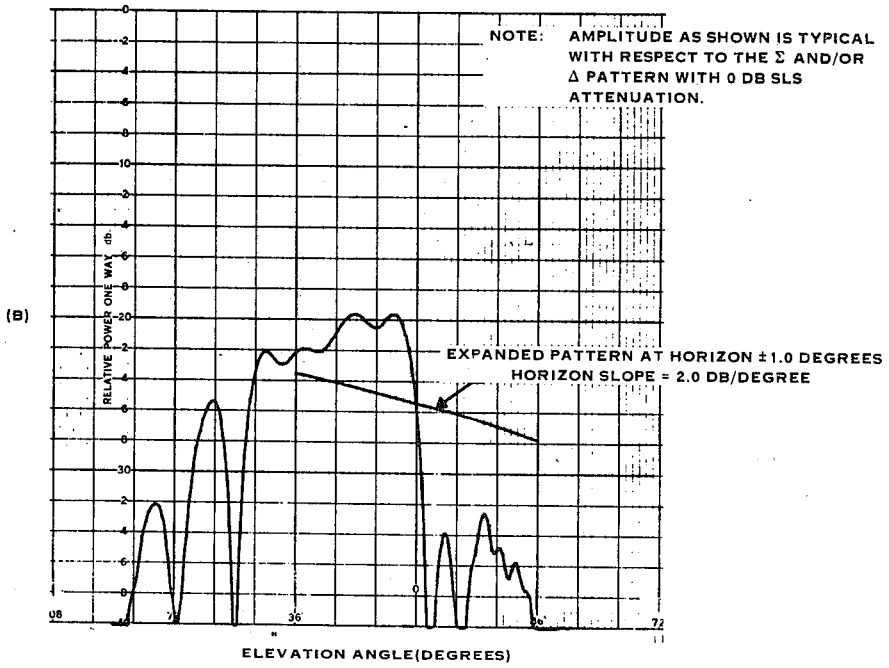
FIG. 14 shows the elevation patterns for the sum, difference, and SLS inputs.

The hybrids of the various power dividers described herein are identical in construction. The hybrids are preferably stripline, waveguide, or coaxial cable type hybrids. For purposes of description a coaxial (rat-race) hybrid (FIG. 8) will be described. A sum input port 184 is provided between two sections 186 and 188 of coaxial cable. The sections 186 and 188 are $\frac{1}{4}$ wavelength ($\lambda$) long. The impedance of the sections 186 and 188 are determined by the circumferences of the outer conductors. A difference port 190 is provided between two sections 192 and 194 of coaxial cable. Section 192 is $\frac{1}{4}\lambda$ long and section 194 is $\frac{3}{4}\lambda$ long to provide, respectively, in phase signals and out-of-phase signals. The overall length of the hybrid ring is $6/4\ \lambda$. The circumferences of the outer conductors of sections 186 and 188, and 192 and 194 provides impedances to divide the RF energy applied, respectively, to the sum port 190.

The names for the hybrid input ports, "sum" and "difference", arise from the phase of the resultant outputs: "sum" yields in-phase outputs while "difference" yields out-of-phase outputs. This terminology for these ports is standard in the microwave industry, but must not be confused with the sum and difference patterns of the antenna, which refers instead of the in-phase and out-of-phase relationships between the two halves of the antenna. This confusion must be avoided since the difference arms of the hybrids are not always used to form the difference patterns of the antenna.

Therefore, in this invention, the required excitations for the difference patterns are achieved by feeding the sum arms of the hybrids and simultaneously applying a small "control-voltage" signal to the difference arms of the hybrids to, in effect, electrically alter the coupling ratio of the hybrid. Because of the 180 degree phase reversal inherent in the difference arm of the hybrid, the control voltage $V_\Delta$ adds to one of the hybrid outputs and subtracts from the other, to change the voltage ratio of the outputs. By proper selection of the control voltage $V_\Delta$, the ratio of the outputs can be changed to any other ratio. The equation for the value $V_\Delta$ required to give a particular output voltage ratio is $V_\Delta = V_\Sigma(K\ K^1-(1-K^2)^{\frac{1}{2}}/(1-K^2)^{\frac{1}{2}}K^1+K)$ where K is the division ratio of the hybrid and $K^1$ is the desired output ratio $V_1/V_2$. The K is a real number, but $V_\Sigma$, $V_\Delta$ and $K^1$ may be complex.

By applying the proper control voltage to each hybrid in the power divider network, the network can produce both the sum and difference amplitude distributions for the antenna, independently optimized, using a single interconnection of hybrids.

For description purposes only the invention will be described in detail in conjunction with an air traffic control radar beacon system. The air traffic control radar beacon (ATCRBS) (FIG. 1) has integral sum ($\Sigma$), difference ($\Delta$), and omnidirectional ($\Omega$) radiation patterns. The sum azimuth pattern is a narrow pencil beam, and in ATCRBS is used to interrogate an aircraft. The difference pattern has a sharp null aligned with the sum pattern, and is used to accurately determine azimuth angle of the aircraft through monopulse techniques.

The omni channel is used for sidelobe suppression (SLS). The SLS omni pattern is an omnidirectional azimuth pattern whose amplitude is lower than the sum peak but higher than any of the sum sidelobes. To permit the aircrafts transponder to distinguish main beam from sidelobe interrogations, the interrogator transmits a pulse on the directional pattern followed two microseconds later by a second pulse on the omni pattern. The transponder compares the amplitude of the two pulses: if the first (directional) is larger than the second (omni), the transponder declares a valid interrogation and issues a reply. However, if the first pulse is smaller than the second, the transponder identifies it as a sidelobe interrogation and does not reply.

The open array antenna (FIG. 1) is, for example, a 5 by 26-foot array of columns of dipole elements for transmission and reception of the air traffic control radio beacon system interrogation and transponder replies. The array contains thirty-five columns 1–35 of ten dipoles. The columns are nine inches apart. Between each pair of columns is a hollow tube 38 containing eighteen short metal rods separated end-to-end by small plastic inserts. Columns 1–35 and 38 are, for example, hollow aluminum and fiberglass rods respectively.

The array is divided into two sections of 17 columns each. The two sections are divided by a single column 18 for the sidelobe suppression signals. The SLS column 18 has only eight dipoles 36 because a better SLS elevation pattern is achieved without the other two. The first and second sections of the array form a 176 degree angle to break up the phasing of the radiation toward the rear hemisphere of the antenna pattern coverage and thus reduce the back radiation.

The antenna includes one additional column 40 of radiating elements. This column called the backfill column is located behind the sidelobe suppression column 18 separating the two sections of the antenna array. This backfill column 40 provides for radiation of the sidelobe suppression pulses in the hemisphere behind the array and is flanked by columns of parasitic dipoles which are used to properly shape the azimuth radiation pattern of the backfill column. It has been found that one parasitic column on each side of the backfill column is sufficient for this purpose. The antenna columns are supported by a frame 41 attached to a support member 42 which can be mounted either on the top of another radar or on a rotatable structure.

Each column 1–35 and 40 has within it a stripline power divider network (FIG. 2) that interconnects the ten dipoles A through J and feeds the correct amplitudes and phases to form the desired sector beam elevation pattern. Table 1 sets forth the nominal amplitude and phase of each dipole of the columns. It has been found that dipoles C and H need not be utilized in forming the elevation of the SLS column and preferably are removed from the SLS column.

TABLE I

| | NOMINAL DIPOLE EXCITATION | | | |
|---|---|---|---|---|
| | Sum Column | | SLS Column | |
| Dipole # | Amplitude | Phase | Amplitude | Phase |
| A(top) | −16.76 | −178 | −13.26 | −153 |
| B | −12.16 | −115 | −18.54 | −91 |
| C | −15.29 | −18 | — | — |
| D | −12.34 | +113 | −22.58 | +84 |
| E | −6.58 | −159 | −7.86 | +179 |
| F | −5.36 | −95 | −3.79 | −98 |
| G | −8.13 | −34 | −6.64 | −16 |
| H | −13.14 | −7 | — | — |

TABLE I-continued

| | NOMINAL DIPOLE EXCITATION | | | |
|---|---|---|---|---|
| | Sum Column | | SLS Column | |
| Dipole # | Amplitude | Phase | Amplitude | Phase |
| I | −13.15 | +1 | −10.78 | −14 |
| J(bottom) | −11.60 | +33 | −12.88 | +46 |

Figure 2:
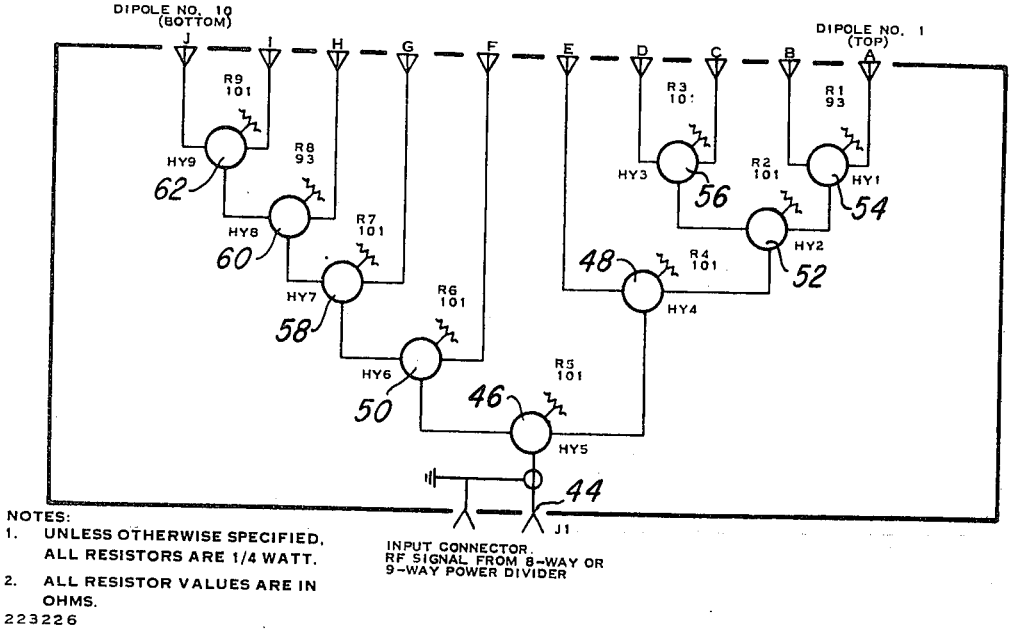
FIG. 2 is a schematic diagram of the power dividing networks for the dipoles of the sum columns.

As shown schematically in FIG. 2, the input signal (hereinafter set forth, Tables II, III & IV) for each sum elevation column is divided among the 10 dipoles A through J using a network of hybrid power dividers. RF power, at terminal 44, is applied to hybrid 46, having a preselected coupling ratio (C.R.). Hybrid 46 divides the power according to its C.R. and feeds it in phase to hybrids 48 and 50. Hybrid 48 divides the power received in accordance with its preselected C.R. and provides the RF power in phase to dipole E at the preselected amplitude and phase (Table I) and to hybrid 52. Hybrid 52 divides the power according to its preselected C.R. and outputs it in phase to hybrids 54 and 56. Hybrid 54 divides the power it receives according to its preselected C.R. and outputs it to dipoles A and B in preselected amplitudes and phases (Table I). Hybrid 56 divides the power it receives according to its preselected C.R. and feeds it to dipoles C and D in preselected amplitudes and phases (Table I).

On the other side of hybrid 46, hybrid 50 divides its received power according to its preselected C.R. and provides dipole F with the RF power at a preselected amplitude and phase (Table I). The remaining RF power of hybrid 50 is applied to hybrid 58. Hybrid 58 according to its preselected C.R. provides RF power to dipole G (Table I) and to hybrid 60. Hybrid 60 divides its power according to its preselected C.R. and provides RF power to dipole H at a preselected amplitude and phase (Table I) and to hybrid 62. Hybrid 62 with its preselected C.R. selectively divides its power to provide RF power, respectively, to dipoles I and J at preselected amplitudes and phases (Table I). The interconnecting lines between the hybrids are printed-circuit strip transmission lines. The lengths of the striplines feeding all dipoles are identical to maximize the band width of the column. However, if the variations are less than one wave length, it is not necessary to have the lengths of the striplines identical.

Figure 3:
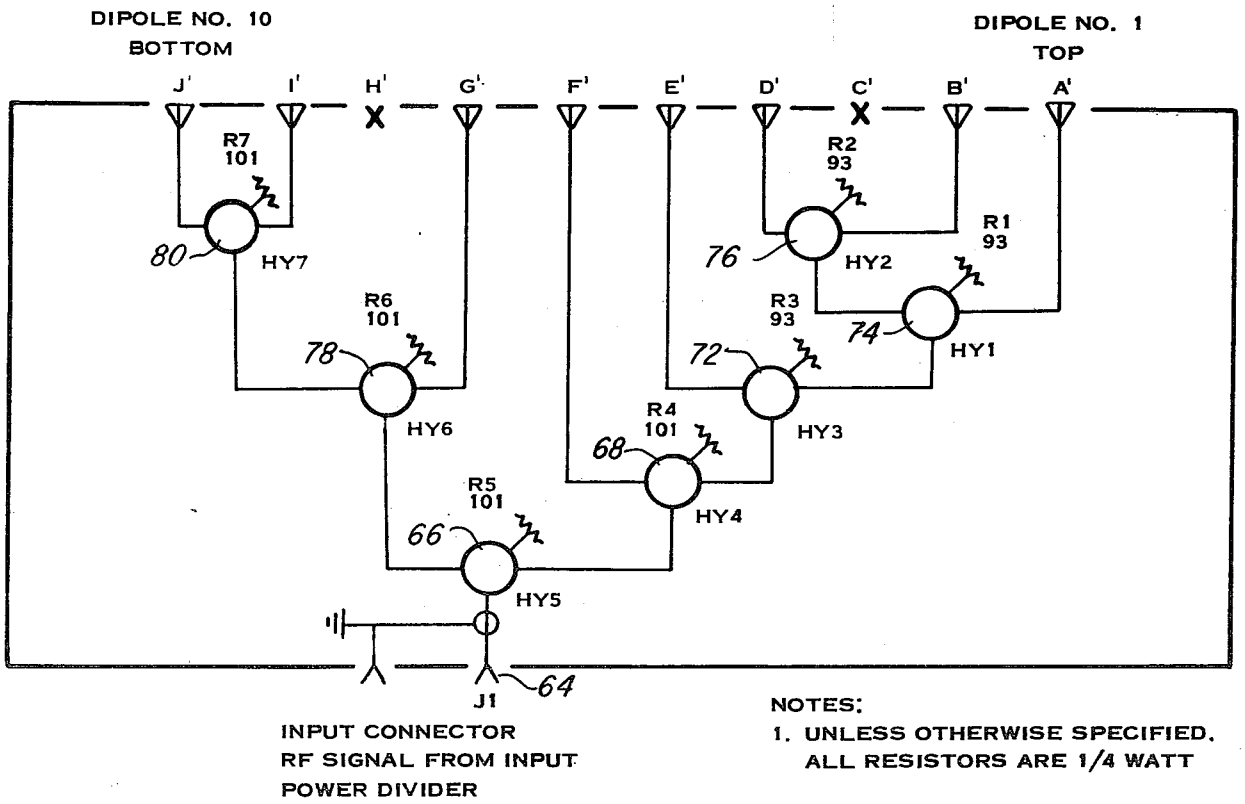
FIG. 3 is a schematic diagram of the power dividing network for the dipoles of the sidelobe suppression column.

Referring now to FIG. 3 in which is disclosed schematically the corporate feed network for the sidelobe suppression (SLS) column 18, the RF input signals ($\Theta$=0.07797W, SLS=0.4018W) are divided among 8 of the dipoles A′ through J′ in the SLS column by hybrid power dividers. The RF input signal is applied to terminal 64 and is divided in phase by hybrid 66 according to its preselected coupling ratio (C.R.) and fed at selected amplitudes and phases to hybrids 68 and 70. Hybrid 68, with its preselected C.R., divides the incoming power to output RF power to dipole F′ at preselected amplitude and phase (Table I) and the remaining power to hybrid 72. Hybrid 72 selectively divides the RF power received according to its C.R. and outputs it to dipole E′ at a selected amplitude and phase (Table) and to hybrid 74. Hybrid 74 selectively divides the power received according to its C.R. and outputs it to dipole A′ at a preselected amplitude and phase (Table I) and to hybrid 76. Hybrid 76 divides the power received according to its C.R. and outputs it to dipoles B and D at preselected amplitudes and phases (Table I). On the left side, hybrid 78 selectively divides its received power according to its C.R. and outputs it to dipole G' at a preselected amplitude and phase (Table I) and to hybrid 80. Hybrid 80 selectively divides the incoming power according to its C.R. and outputs it at preselected amplitudes and phases to dipoles I' and J' (Table I). It will be noted that dipoles C' and H' are not fed. As in the sum elevation column circuit, the power dividers of the SLS column circuit are interconnected by strip transmission lines. The lengths of the striplines feeding all dipoles are as nearly equal as possible to maximize frequency band width.

The elevation pattern produced by the columns is characterized by a rapid roll off of energy below the horizon. Energy at and below the horizon is undesirable because it: reflects from hangers and other structures around airports to give targets at incorrect azimuth angles, and reflects from the surface of the earth to cause multipath nulls in the above-horizon coverage.

Figure 4:
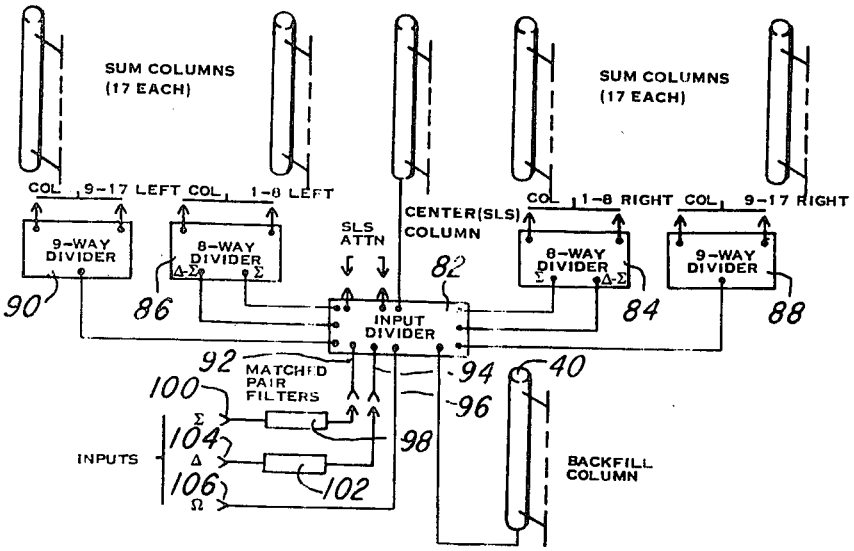
FIG. 4 is a block diagram of the major RF components of the multiple beam feed network.

Referring now to FIG. 4, the multiple beam feed network comprises an input power divider 82, two 8-way power dividers 84 and 86 and two 9-way dividers 88 and 90 arranged in a corporate structure. The input divider 82 has three RF energy input terminals 92, 94 and 96. Input terminal 92 is connected to filter 98 of a matched pair of filters. Filter 98 is connected to the sum pattern input terminal 100. Input terminal 94 is connected to filter 102 of the matched pair filters, and filter 102 is connected to the difference pattern input terminal 104. Input terminal 96 is connected to the omnidirectional (Ω) radiation pattern input terminal 106.

Figure 5:
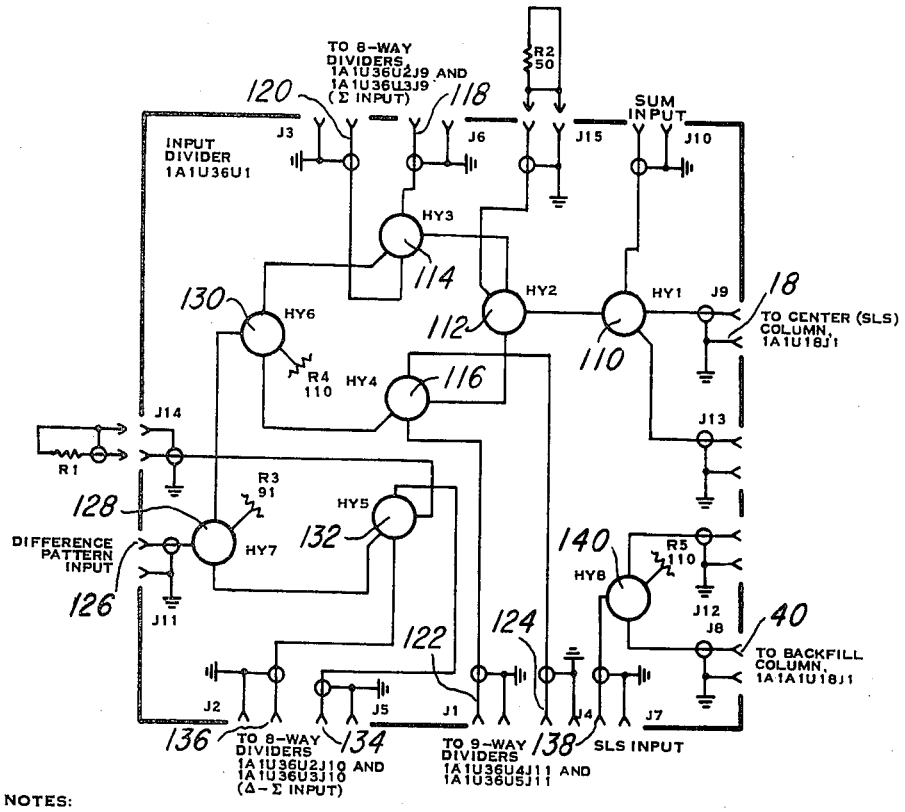
FIG. 5 is a schematic diagram of the input power divider of the multiple beam feed network.

Referring now to FIG. 5, the input power divider 82 has a sum pattern input terminal 108 connected to the sum arm of hybrid 110. Hybrid 110 with a preselected coupling ratio (C.R.) has output terminals connected to center column (SLS) 18 and to the sum arm of hybrid 112. Hybrid 112 with a preselected C.R. has output terminals connected to the sum arms of hybrids 114 and 116. Hybrid 114 has a C.R. to divide the power equally and in phase to output terminals 118 and 120 connected to the sum input terminals of the two 8-way power dividers 84 and 86, while hybrid 116 has a C.R. to divide the power equally and in phase to output terminals 122 and 124 connected to the sum terminals of the two 9-way power dividers 88 and 90.

The difference pattern input terminal 126 (FIG. 5) is connected to the sum arm of hybrid 128. Hybrid 128 with a preselected coupling ratio (C.R.) has output terminals connected to the sum arm of hybrid 130 and to the difference arm of hybrid 132. Hybrid 130 with a preselected coupling ratio has output terminals connected to the difference arms of hybrid 114 and 116. Hybrid 114 with its preselected ratio divides the power equally and out-of-phase to the sum output terminals 118 and 120 connected to the two 8-way dividers 84 and 86, while hybrid 116 has a coupling ratio to divide the power equally and out-of-phase to output terminals 122 and 124 leading to the two 9-way power dividers 88 and 90. Hybrid 132 has a coupling ratio to divide the power equally and out-of-phase to output terminals 134 and 136 connected to 8-way dividers 84 and 88 (Δ−Σ) input terminals.

The SLS input terminal 138 (FIG. 5) is connected to the sum arm of hybrid 140. Hybrid 140 with a preselected coupling ratio has output arms connected, respectively, to the backfill column of dipoles 40 and to the difference arm of hybrid 110. Hybrid 110 with its preselected C.R. has its output arms connected respectively, to SLS column 18 and to the sum arm of hybrid 112. Hybrid 112 with its preselected C.R. has its outputs connected to hybrids 114 and 116. Hybrid 114 with its preselected C.R., has its output arms connected to output terminals 118 and 120 feeding the Σ input terminals of the two 8-way power dividers 84 and 86. While hybrid 116, with its preselected C.R., has its output arms connected to output terminals 122 and 124 feeding the two 9-way power hybrids 88 and 90.

Figure 6:
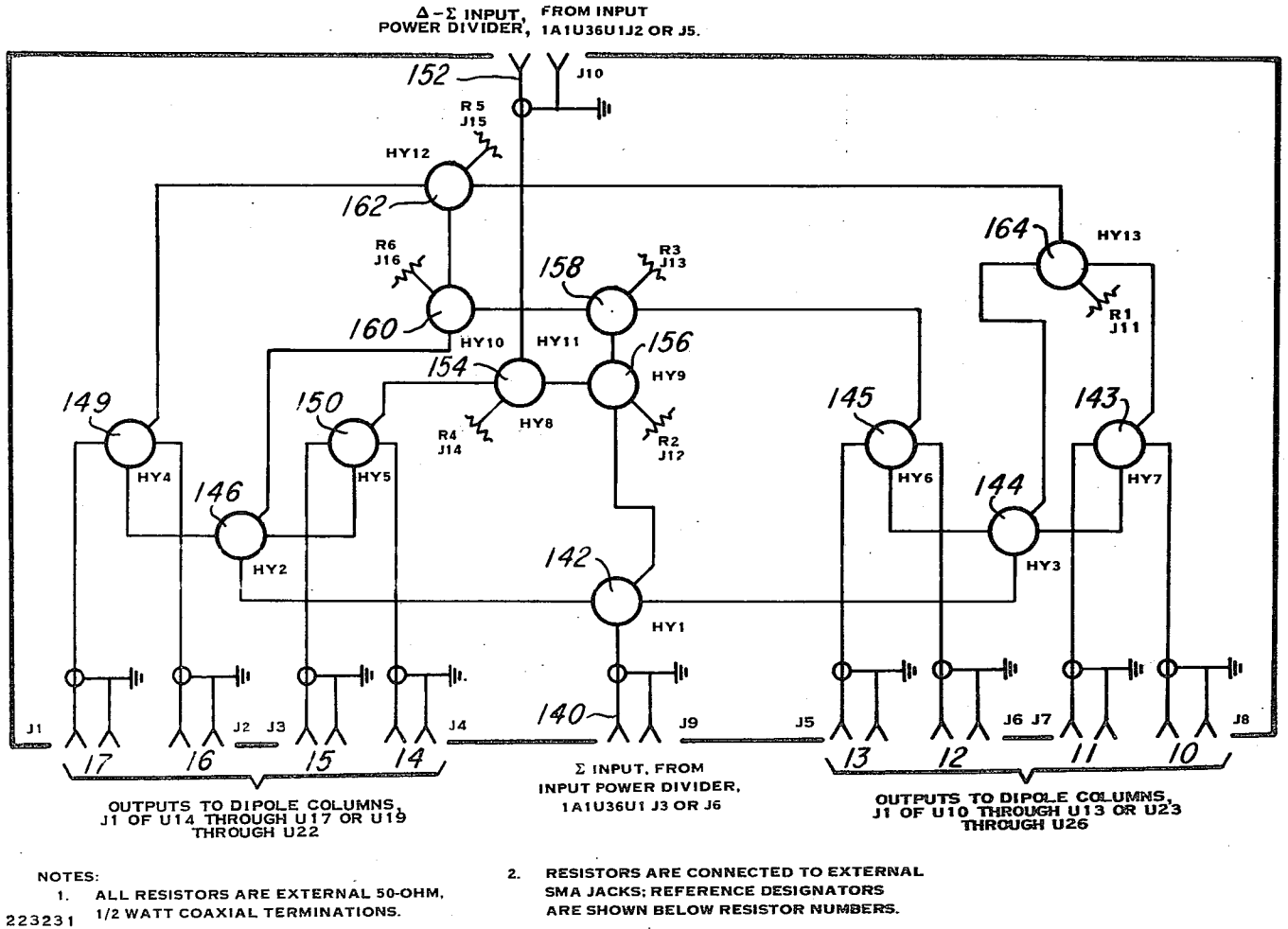
FIG. 6 is a schematic diagram of the 8-way power divider for the multiple beam feed network.

The two 8-way power dividers 84 and 86 are identical in structure; therefore, only one need be described. The sum (Σ) input terminal 140 and the difference minus sum (Δ−Σ) terminal 152 of the 8-way power divider 86 (FIG. 6) are connected, respectively, to the Σ output terminal 120 and the (Δ−Σ) output terminal 136 of the input power divider 82 (FIG. 5). The terminals 140 and 152 of the 8-way power divider 86 (FIG. 6) lead, respectively, to sum arms of hybrids 142 and 154. Hybrid 154 with a preselected coupling ratio (C.R.) has output arms connected, respectively, to a difference arm of hybrid 150 and to a sum arm of hybrid 156. Hybrid 156 with a preselected C.R. has output arms connected, respectively, to a difference arm of hybrid 142 and a sum arm of hybrid 158. Hybrid 158 with a preselected coupling ratio has output arms connected, respectively, to the difference arm of hybrid 145 and to the sum arm of hybrid 160. Hybrid 160 with a preselected coupling ratio has output arms connected, respectively, to a difference arm of hybrid 146 and to the sum arm of hybrid 162. Hybrid 162 with a preselected C.R. has output arms connected, respectively, to the difference arm of hybrid 149 and to a sum arm of hybrid 164. Hybrid 164 with a preselected coupling ratio has output arms connected, respectively, to difference arms of hybirds 145 and 148. Returning now to hybrid 142, it has a preselected C.R. and output arms connected, respectively, to sum arms of hybrids 144 and 146. Hybrid 144 with a preselected C.R. has output arms connected, respectively, to sum arms of hybrids 145 and 148. Hybrid 146 with a preselected C.R. has output arms connected to sum arms of hybrids 149 and 150. Hybrid 148 with a preselected C.R. has output arms connected to columns of dipoles 10 and 11, while hybrid 145 with a preselected C.R. has output arms connected to columns of dipoles 12 and 13. Hybrid 150 with a preselected C.R. has output arms connected to columns of dipoles 14 and 15, while hybrid 149 with a preselected C.R. has output arms connected to columns of dipoles 16 and 17.

Figure 7:
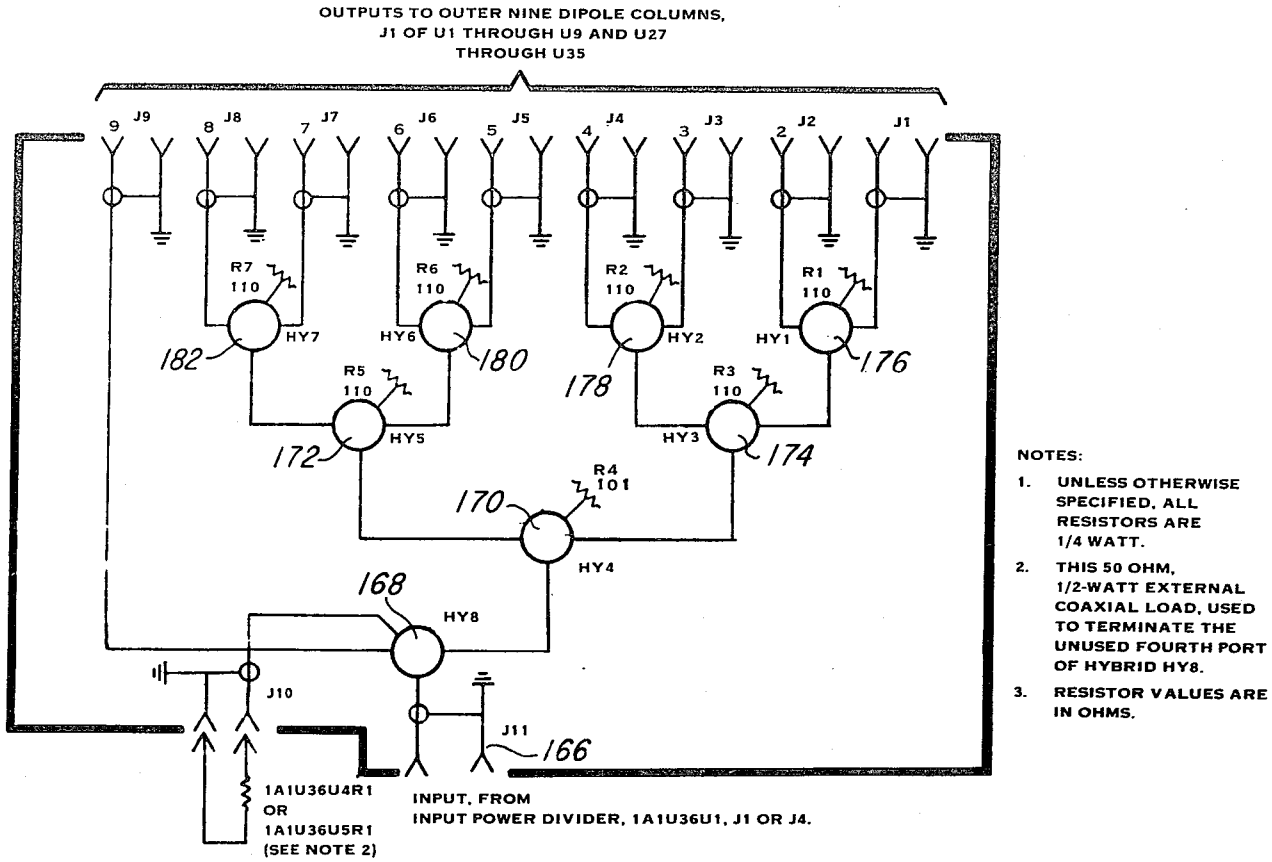
FIG. 7 is a schematic diagram for the 9-way divider of the multiple beam feed network.

The two 9-way power dividers 88 and 90 are identical in structure; therefore, only one need be described. The input terminal 166 of the 9-way power divider 82 (FIG. 5) is connected to output terminal 122 of the input power divider 82 (FIG. 8) and sum arm of hybrid 168 of the 9-way power divider 90 (FIG. 7). Hybrid 168 with a preselected coupling ratio (C.R.) has output arms connected respectively, to dipole column 9, and to sum arm of the hybrid 170. Hybrid 170 with a preselected C.R. has output arms connected, respectively, to hybrids 180 and 182, while hybrid 174 with a preselected C.R. has output arms connected, respectively, to sum arms of hybrids 176 and 178. Hybrid 176 with a preselected C.R. has output arms connected, respectively, to columns of dipoles 1 and 2. Hybrid 178 with a preselected C.R. has output arms connected, respectively, to columns of dipoles 3 and 4. Hybrid 180 with a preselected C.R. has output arms connected to columns of dipoles 5 and 6, while hybrid 182 with a preselected C.R. has output arms connected to columns of diples 7 and 8.

Figure 9:
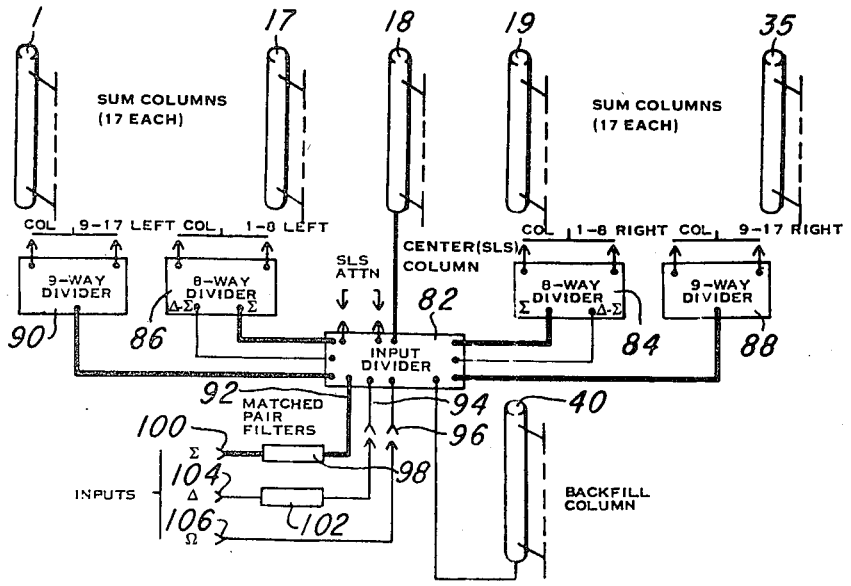
FIG. 9 is a signal flow diagram showing the flow of the sum signals through the multiple beam feed network.

In summary, when RF energy is supplied to the sum terminal 100, it flows through the filter 98 (FIG. 9, boldlines) to the input divider 82. In the input divider, power is divided and route to the Σ terminals of two 8-way dividers 84 and 86, the two 9-way dividers 88 and 90, and to the center sidelobe suppression (SLS) column 18. From the power dividers, the RF energy flows to the columns of dipoles 1–17 and 19–35.

When RF energy is applied to the difference terminal 104, (FIG. 10, boldlines) it flows through filter 102 to the input divider 82. From the input divider 82, the divided RF energy flows to the sum (Σ) and difference minus sum (Δ−Σ) terminals of the two 8-way power dividers 84 and 86, to the two 9-way power dividers 88 and 90, and from these power dividers to the columns of dipoles 1–17 and 19–35. The sidelobe suppression column 18 is not fed. In the difference mode, the feed network applies a 180 degree phase reversal to all signals of the first section of columns (1–17) of the array relative to all the signals of the second section of columns (19–35).

Figure 11:
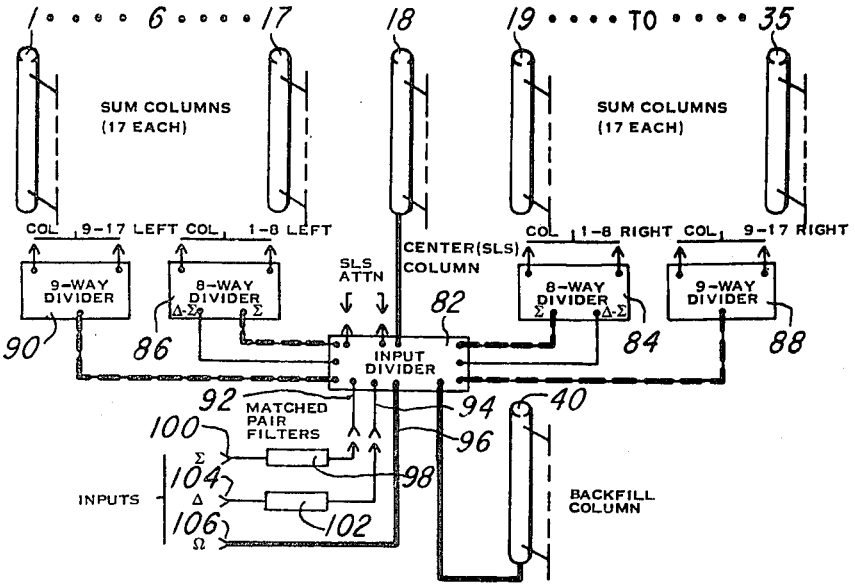
FIG. 11 is a signal flow diagram showing the sidelobe suppression signal flow through the multiple beam feed network.

When RF power is applied to omnidirectional or sidelobe suppression (SLS) input terminal 106 (FIG. 11 boldlines) it flows to the power divider 82 where it is divided and fed to the center (SLS) column 18, backfill column 40, and a small part of the power (about 3%) is fed to the columns 1–17 and 19–35 through the sum input terminals of the two 8-way power dividers 84 and 86 and the two 9-way power dividers 88 and 90.

The azimuth sum pattern (FIG. 12) is formed by feeding all 35 columns in approximately a cophased condition to form a high-gain broadside array. To control sidelobe radiation, the columns near the center of the array are fed at higher amplitudes than those near the edges. That is, the array uses a tapered amplitude distribution to form the azimuth sum pattern. In our example, the edge taper is approximately −17 dB. The taper is a modification of a Taylor taper for 35 dB sidelobes. Taylor's ideal taper is modified in a compromise between the sum and difference pattern, yielding a computed sidelobe level of −32 dB instead of −35 dB. The compromise will be hereinafter explained in connection with the difference pattern.

Figure 12:
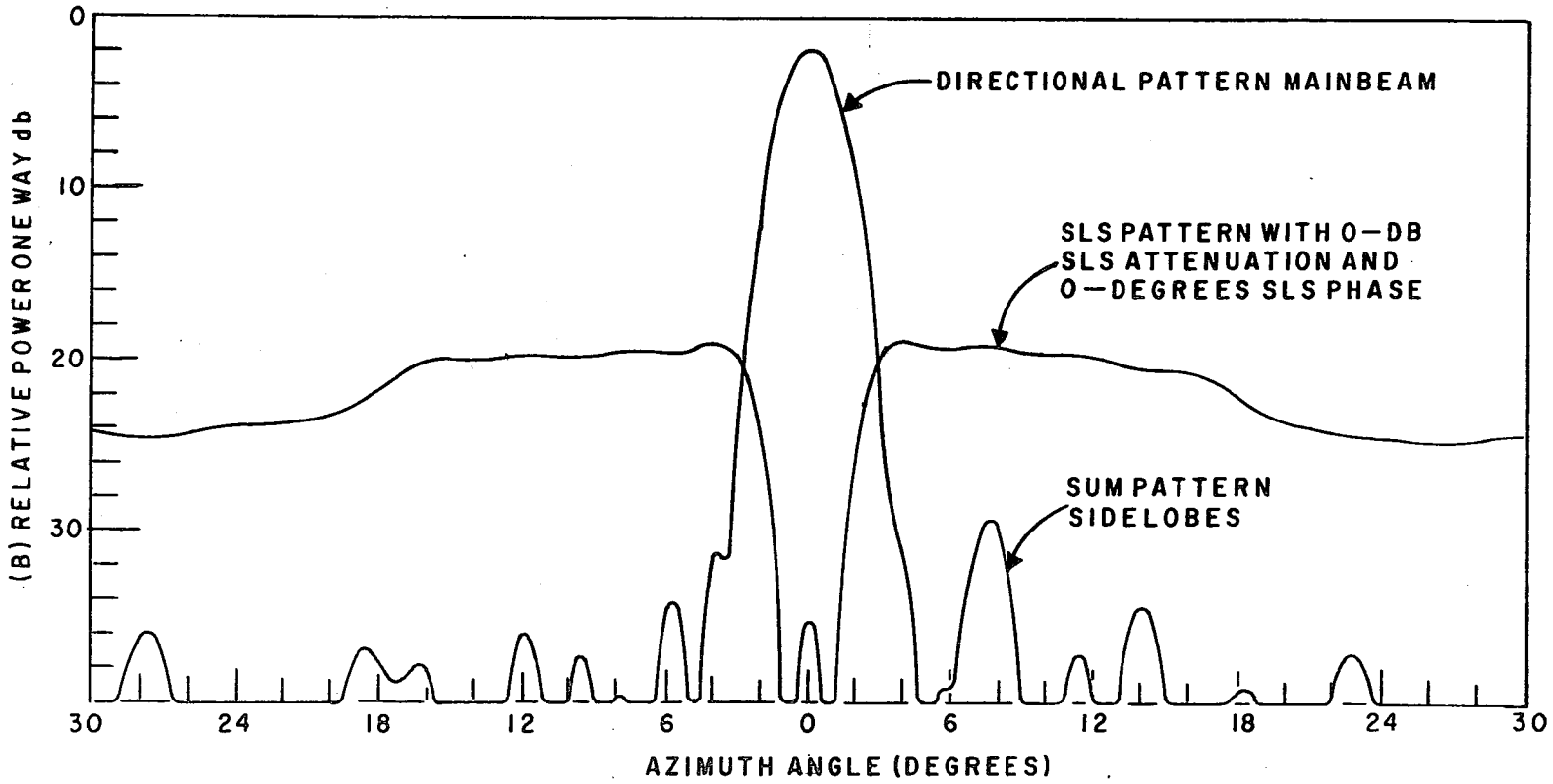
FIG. 12 shows the azimuth sum pattern together with the SLS pattern.

In the azimuth, the sum pattern is a pencil beam that is about 4 degress wide (at the 10 dB points), with sidelobe radiation outside the main beam region suppressed to low levels, about −27 dB. The SLS pattern has a null in the region of the sum main beam to minimize main beam kill by the SLS system. The SLS pattern is shown in FIG. 12 together with its associated sum pattern.

The azimuth difference pattern (FIG. 13) is formed by feeding the array of columns to form a broadside array. In this mode, the right and left sections of the array are fed in phase opposition to form a difference null. The difference distribution is also tapered for low sidelobes. The taper is constrained to be identical to the sum taper of the outer nine columns of each section of columns, but differs significantly in the center of the array. Thus, the implementation is accomplished by using a 9-way power divider and an 8-way power divider in each section. By using a 9-way power divider, the long feed lines to the outer array columns necessary for optimizing these columns are eliminated, and only the center array columns fed by the 8-way power dividers need be optimized. Optimization is achieved by determining from low sidelobe sum distribution a low sidelobe difference distribution as follows:

Let f(x) represent a low sidelobe amplitude taper (such as Taylor). The distribution is scanned to broadside (no phase shift along the aperture). To scan this beam slightly off boresight, the distribution becomes:

$$f'(x)=f(x)e^{-jkx}$$

Scanned the same distance to the other side of boresight, the distribution is:

$$f''(x)=f(x)e^{+jkx}$$

Both of these beams still have the low sidelobe character of the original distribution. Adding the two beams together, out of phase, gives a low sidelobe difference pattern:

$$f'(x)-f''(x)=f(x)d^{+jkx}-e^{-jkx}=2f(x)\sin kx$$

where:

f(x) is Taylor's low sidelobe sum pattern, k determines how far off boresight the two difference peaks are scanned-usually between $\pi/2$ and $\pi$. A value of 2.2 is preferred to give maximum similarity of the sum and difference tapers near the outer edges of the array, as described in the following discussion.

Near the apex of the sin kx wave in the above equation, the value of the function sin kx is approximately 1.0. Therefore, by selecting the value of k in the above equation so that the apex of the sin kx wave coincides with that part of distribution which represents the outer edges of the array (the part of the array fed by the nine-way power dividers), the sum and difference distributions will have approximately the same shapes, since sin kx is approximately equal to 1.0 in that region. By applying this constraint in the array, the nineway power dividers are significantly simplified.

As the open array antenna is "V" shaped (176°) it is necessary for a broadside array that the phase of the columns outputs be adjusted to compensate for the offset each column has from a planar position. Compensation is accomplished by varying the length of the stripline connecting the column of dipoles to its hybrid of the feeder network.

Figure 13:
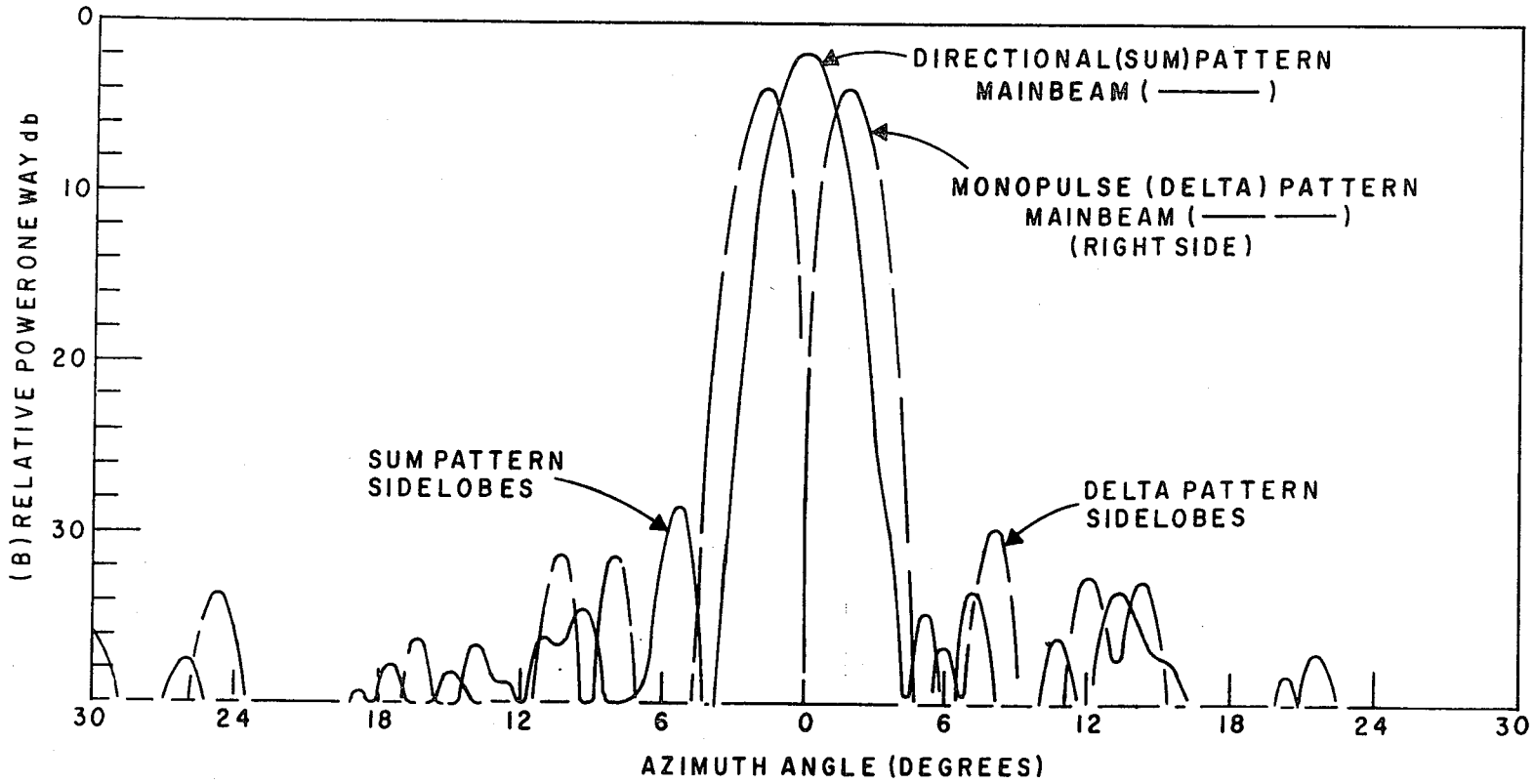
FIG. 13 shows the azimuth difference pattern.

The difference pattern in azimuth contains two pencil beam peaks symmetrically displaced about 2° on either side of the sum peak. It has a deep null that is aligned with the sum pattern peak and it also has low sidelobes (−25 dB). The difference pattern is shown in FIG. 13 in relation to the sum pattern.

The elevation pattern of the sum, difference and SLS have basically the same elevation behavior. That is, they have approximately uniform gain from the horizon to 30° above the horizon, with some additional coverage above +30° at reduced gain. The radiation pattern falls off rapidly at and below the horizon to minimize reflections from the surrounding terrain. FIG. 13 shows the elevation patterns for the sum, difference, and SLS inputs.

Tables II, III and IV set forth the sum, difference and SLS azimuth excitations for our example.

TABLE II

| | SUM Amplitude | | | |
|---|---|---|---|---|
| Column Number | dB | Volts | 2 Volts = Pow. | Phase Deg. |
| (Center) | −11.08 | .27925 | .07797 | 0 |

TABLE II-continued

| Column Number | SUM Amplitude dB | Volts | 2 Volts = Pow. | Phase Deg. |
|---|---|---|---|---|
| 17 | −12.02 | .25061 | .06280 | −10.2 |
| 16 | −12.18 | .24604 | .06052 | −20.3 |
| 15 | −12.44 | .23878 | .05701 | −30.5 |
| 14 | −12.81 | .22882 | .05235 | −40.6 |
| 13 | −13.29 | .21652 | .04687 | −50.8 |
| 12 | −13.88 | .20230 | .04092 | −60.9 |
| 11 | −14.59 | .18642 | .03474 | −71.1 |
| 10 | −15.44 | .16904 | .02857 | −81.2 |
| 9 | −16.82 | .14421 | .02079 | −91.4 |
| 8 | −17.72 | .13002 | .01689 | −101.5 |
| 7 | −18.85 | .11416 | .01302 | −111.7 |
| 6 | −20.22 | .09750 | .00950 | −121.9 |
| 5 | −21.83 | .08100 | .00655 | −132.0 |
| 4 | 23.63 | .06584 | .00433 | −142.2 |
| 3 | −25.46 | .05333 | .00283 | −152.3 |
| 2 | −27.10 | .04416 | .00194 | −162.5 |
| 1(Edge) | −28.24 | .03873 | .00149 | −172.6 |
| | | Total: | 1.00000 | |

Notes:
1. Distribution is symmetrical about center column.
2. Total power is center column plus twice columns 1–17.
3. Column does not add exactly due to round-off errors.
4. Total is twice columns 1–17.
5. Remaining half of SLS power goes back to backfill column.

TABLE III

| Column Number | DIFFERENCE Amplitude dB | Volts | 2 Volts = Pow. | Phase Deg. |
|---|---|---|---|---|
| (Center) | | NOT USED | | |
| 17 | −25.42 | .05355 | .00287 | −100.2 |
| 16 | −19.63 | .10430 | .01088 | −110.3 |
| 15 | −16.50 | .14955 | .02236 | −120.5 |
| 14 | −14.53 | .18762 | .03520 | −130.6 |
| 13 | −13.27 | .21691 | .04705 | −140.8 |
| 12 | −12.53 | .23620 | .05579 | −150.9 |
| 11 | −12.20 | .24535 | .06019 | −160.1 |
| 10 | −12.26 | .24366 | .05937 | −171.2 |
| 9 | −12.56 | .23539 | .05541 | +178.6 |
| 8 | −13.46 | .21222 | .04504 | +168.5 |
| 7 | −14.59 | .18633 | .03472 | +158.3 |
| 6 | −15.96 | .15914 | .02533 | +148.1 |
| 5 | −17.57 | .13221 | .01748 | +138.0 |
| 4 | −19.37 | .10747 | .01155 | +127.8 |
| 3 | −21.20 | .08705 | .00758 | +117.7 |
| 2 | −22.84 | .07207 | .00519 | +97.4 |
| 1 (Edge) | −23.98 | .06321 | .00400 | +97.4 |
| | | Total: | 1.0000 | |

Note:
(Notes under TABLE II are applicable)

TABLE IV

| Column Number | SLS Amplitude dB | Volts | $Volts^2$ = Pow. | Phase Deg. |
|---|---|---|---|---|
| (Center) | −3.19 | .69295 | .48018 | 0.0 |
| 17 | −28.70 | .03674 | .00135 | 169.8 |
| 16 | −28.86 | .03607 | .00130 | 159.7 |
| 15 | −29.12 | .03501 | .00123 | 149.5 |
| 14 | −29.49 | .03355 | .00113 | 139.4 |
| 13 | −29.97 | .03174 | .00101 | 129.2 |
| 12 | −30.56 | .02966 | .00088 | 119.1 |
| 11 | −31.27 | .02733 | .00075 | 108.9 |
| 10 | −32.12 | .02478 | .00061 | 98.8 |
| 9 | −33.50 | .02114 | .00045 | 88.6 |
| 8 | −34.40 | .01906 | .00036 | 78.5 |
| 7 | −35.53 | .01674 | .00028 | 68.3 |
| 6 | −36.90 | .01429 | 00020 | 58.1 |
| 5 | −38.51 | .01188 | .00014 | 48.0 |
| 4 | −40.31 | .00965 | .00009 | 37.8 |

TABLE IV-continued

| Column Number | SLS Amplitude dB | Volts | $Volts^2$ = Pow. | Phase Deg. |
|---|---|---|---|---|
| 3 | −42.14 | .00782 | .00006 | 27.7 |
| 2 | −43.78 | .00647 | .00004 | 17.5 |
| 1 (Edge) | −44.92 | .00568 | .00003 | 7.4 |
| | | Total: | .50000 | |

Note:
(Notes under TABLE II are applicable)

The values of Tables II, III and IV are derived from a description of the operation of the feed network of the open array antenna example. The sum pattern input terminal 108 (FIG. 5) receives 1.00000 watt of power from a source of RF energy (not shown). Hybrid 110, with a coupling ratio of 0.07797, provides 0.07797 watt (W) to the center (SLS) column of dipoles 18, and 0.92203 watt (W) to the sum arm of hybrid 112. Hybrid 112, with a coupling ratio of 0.15592, provides 0.76756 W to sum arm of hybrid 114 and 0.15468 W to the sum arm of hybrid 116. Hybrid 114, with a coupling ratio of 0.500, provides 0.38378 W in phase to Σ output terminals 118 and 120 for the sum input terminals of the two 8-way power dividers 84 and 86. While hybrid 116 with a coupling ratio of 0.500, provides 0.07734 W in phase to the output terminals 122 and 124 for the sum input terminals of the two 9-way power dividers 88 and 90.

The SLS pattern input terminal 138 (FIG. 5) receives 1.00000 W RF energy from the RF source (not shown). Hybrid 140, with a coupling ratio of 0.50000, divides the 1 watt equally and in phase and provides 0.50000 W to the backfill column of dipoles 40 and 0.50000 W to the difference arm of hybrid 110. Hybrid 110, with a coupling ratio of 0.07797 provides 0.48018 W in phase to the center (SLS) column of dipoles 18, and 0.01982 W out-of-phase to hybrid 112. Hybrid 112, with a coupling ratio of 0.15592, divides the power and provides in phase 0.01652 W to hybrid 114 and 0.00330 W to hybrid 116. Hybrid 114, with a coupling ratio of 0.50000, divides the 0.01652 power equally and in phase and provides 0.00826 W to each output terminal 118 and 120 for the two 8-way power dividers 84 and 86.

Finally, the difference pattern input terminal 126 receives 1.00000 W from the source thereof (not shown). Hybrid 128, with a coupling ratio of 0.12036, provides 0.12036 W to the difference arm of hybrid 132, and 0.87964 W to the sum arm of hybrid 130. Hybrid 132, with a coupling ratio of 0.500 divides the power equally and provides 0.06018 W in phase to output terminal 136, and 0.06018 W out-of-phase to output terminal 134. Output terminals 136 and 134 are, respectively, for the (Δ−Σ) input terminals of the two 8-way power dividers. Hybrid 130, with a coupling ratio of 0.4906, divides the 0.87964 in phase and provides 0.46704 W to the difference arm of hybrid 114 and 0.41260 W to the difference arm of hybrid 116. Hybrid 114, with a coupling ratio of 0.500, divides the 0.46704 W equally and provides 0.23352 W in phase to output terminal 120 and 0.23352 W out-of-phase to output terminal 118. Terminals 118 and 120, are respectively, for the sum terminals of two 8-way power dividers 84 and 86. Hybrid 116, with a coupling ratio of 0.500, divides the 0.41260 W equally and provides 0.20630 W in phase to output terminal 122 and 0.20630 W out-of-phase to output terminal 124. Output terminals 122 and 124 as previously mentioned are for the two 9-way power dividers 88 and 90.

The Σ input pattern terminal 140 of the 8-way power divider (FIG. 6) receives from the sum terminal 120 of the input power divider 0.38378 W for the sum pattern, 0.00826 W for the SLS pattern and 0.23352 W for the difference pattern. This power distribution is such that the beams are independent of each other (orthogonal). The 0.38378 W power for the sum pattern is applied to the sum arm of hybrid 142. Hybrid 142, with a coupling ratio of 0.3972, provides 0.15110 W to the sum arm of hybrid 144 and 0.23268 W to the sum arm of hybrid 146. Hybrid 144, with a coupling ratio of 0.41889, provides 0.08779 W to the sum arm of hybrid 145 and 0.06331 W to the sum arm of hybrid 148. While hybrid 146, with a coupling ratio of 0.47000, provides 0.12332 W to the sum arm of hybrid 149 and 0.10936 W to the sum arm of hybrid 150. Hybrid 148 with a coupling ratio of 0.4512 divides the 0.06331 W and provides 0.02857 W in phase to column of dipoles 10 and 0.03474 W in phase to column of dipoles 11. While hybrid 145, with a coupling ratio of 0.46611, divides the 0.08779 W and provides 0.04092 W in phase to column of dipoles 12 and 0.04687 W in phase to column of dipoles 13. Hybrid 150, with a coupling ratio of 0.47869, divides 0.10936 W and provides 0.05235 W in phase to column of dipoles 14 and 0.05701 W in phase to column of dipoles 15. While hybrid 149, with a coupling ratio of 0.49076, divides the 0.12332 power and provides 0.06052 W in phase to column of dipoles 16, and 0.06280 W in phase to column of dipoles 17.

For the SLS output, −0.00826 W from the input power divider is applied in quadrature to the sum pattern input terminal 140. Hybrid 142, with its coupling ratio of 0.39372, divides the −0.00826 W and provides −0.00325 W to hybrid 144 and −0.00501 W to hybrid 146. Hybrid 144, with its coupling ratio of 0.41899, divides the −0.00325 W in phase and provides −0.00136 W and −0.00189 W, respectively, to hybrids 148 and 145. While hybrid 146, with its coupling ratio of 0.4700, divides the −0.00501 W and provides −0.00235 W and −0.00266 W, respectively, to hybrids 150 and 149. Hybrid 148, with its coupling ratio of 0.45127, divides the −0.00136 and provides −0.00061 W and 0.00075 W, respectively, to columns of dipoles 10 and 11. While hybrid 145, with its coupling ratio of 0.46611, divides the −0.00189 W and provides −0.00088 W and −0.00101 W, respectively, to columns of dipoles 12 and 13. Hybrid 150, with its coupling ratio of 0.47869, divides the −0.00235 W and provides −0.00112 W and −0.00123 W, respectively, to columns of dipoles 14 and 15. While hybrid 149, with its coupling ratio of 0.49076, divides the −0.00266 W and provides, respectively, −0.00130 W and −0.00136 W to columns of dipoles 16 and 17.

For the difference channel, a sum (Σ) value of 0.23352 W is received from the power input divider at the sum input 140 and a difference minus sum (Δ−Σ) value of 0.06018 W is received at Δ−Σ input terminal 152. The 0.06018 W controls the action of the feed network to optimize the difference pattern. Hybrid 154 with a coupling ratio of 0.1694 receives the 0.0.06018 W at its sum arm divides it in phase and provides 0.05918 W and 0.00102 W, respectively to the sum arm of hybrid 156 and to the difference arm of hybrid 150. Hybrid 156, with a coupling ratio of 0.24941, divides the 0.05918 W and provides 0.01476 W and 0.04442 W, respectively, to the sum arm of hybrid 158 and to the difference arm of hybrid 142. Hybrid 158, with a coupling ratio of 0.04065, divides the 0.01476 W in phase and provides 0.01416 W and 0.00060 W, respectively to the sum arm of hybrid 160 and to the difference arm of hybrid 145. Hybrid 160, with a coupling ratio of 0.33828, divides the 0.01416 W in phase and provides 0.00479 W and 0.00937 W, respectively, to the sum arm of hybrid 162 and to the difference arm of hybrid 146. Hybrid 162, with a coupling ratio of 0.28601, divides the 0.00479 W in phase and provides 0.00342 W and 0.00137 W, respectively, to the sum arm of hybrid 164 and the difference arm of hybrid 149. Hybrid 164, with a coupling ratio of 0.07018, divides the 0.00342 W and provides 0.00024 W and 0.00317 W, respectively, to the difference arms of hybrids 148 and 144. Returning to hybrid 142, hybrid 142, with its coupling ratio of 0.39372 divides the 0.23352 W in phase and the 0.04442 W out-of-phase and as the RF energy is in the same mode of wave propogation the power combines to provide 0.1838 W and 0.5955 W, respectively, to the sum arms of hybrids 144 and 146. The 0.21838 W and 0.5955 W is obtained as follows. The power inputs in watts to the hybrid are converted to volts by taking their square roots and the coupling ratios of the hybrid is converted correspondingly by taking their square roots. Thus, the sum input $(0.23352\ W)^{\frac{1}{2}}=0.48324$ V; the difference $(0.04442)^{\frac{1}{2}}=0.21076$ V; the coupling ratio to the cold port $(0.39372)^{\frac{1}{2}}=0.62747$, and the coupling ratio to the hot port $(0.60628)^{\frac{1}{2}}=0.77864$. The sum voltage outputs of the hybrid are: (0.48324 V) (0.77864)=0.37627 V at the hot side; and (0.48324 V) (0.62747)=0.30322 V at the cold side. While, the difference voltage outputs of the hybrid are: (0.21076 V) (0.62747)=−0.13225 V at the hot side; and (0.21076 V) (0.77864)=+0.16411 V at the cold side. These voltages combine as follows: for the cold side 0.37627 V−0.13225=0.24402 V and at the hot side 0.30322 V+0.16411 V=0.46733 V. To convert these voltages to watts it is necessary to square them; thus, $(0.24402\ V)^2=0.05955$ W and $(0.46733\ V)^2=0.21839$ W. This procedure is followed to compute the difference outputs of the remaining hybrids of the 8-way power divider.

Hybrid 144, with its coupling ratio of 0.41899 divides the 0.21839 W sum power and the 0.00317 W difference power and provides 0.10224 W and 0.11931 W, respectively, to the sum arms of hybrids 145 and 148. While hybrid 146, with its coupling ratio of 0.4700, divides the 0.05955 W sum power and the 0.00937 W difference power and provides 0.01238 W and 0.05654 W, respectively, to the sum arms of hybrids 149 and 150. Hybrid 148, with its coupling ratio of 0.45127 divides the 0.06331 W applied to its sum arm and the 0.00024 W applied at its difference arm, combines them and provides, 0.05937 W and 0.06019 W, respectively to columns of dipoles 10 and 11. While hybrid 145, with its coupling ratio of 0.46611, divides the 0.10224 W applied to its sum arm and 0.00060 W applied to its difference arm, combines them, and provides 0.05579 W and 0.04705 W, respectively, to columns of dipoles 12 and 13. Hybrid 150, with its coupling ratio of 0.47869, divides the 0.05654 W applied to its sum arm and the 0.00102 W applied to its difference arm, combines them, and provides 0.03520 W and 0.02236 W, respectively, to columns of dipoles 14 and 15. While, finally, hybrid 149, with its coupling ratio of 0.49076, divides the 0.01238 W applied to its sum arm and the 0.00137 W applied to its difference arm, combines them and provides 0.01088 W and 0.00287 W, respectively, to columns of dipoles 16 and 17.

The two 9-way power dividers 88 and 90 (FIG. 7) are identical in structure to provide equal power to the columns of dipoles of the two 9-way power dividers for the sum, SLS, and difference paterns. The power applied to the two 9-way power dividers is in phase for the sum and SLS patterns, but for the difference pattern the power of the second 9-way power divider is out-of-phase to that of the first 9-way power divider.

Figure 10:
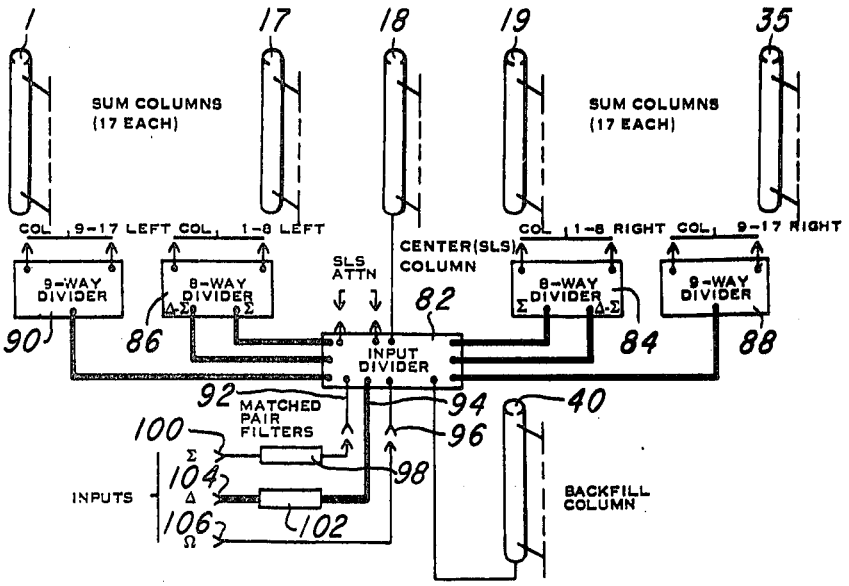
FIG. 10 is a signal flow diagram showing the flow of the difference signal through the multiple beam feed network.

The 0.7734 W for the sum pattern, 0.00165 W for the SLS pattern and the 0.20630 W for the difference pattern from terminal 122 of the input power divider 82 (FIG. 8) is received at terminal 166 of the 9-way power divider 90 (FIG. 10). For the sum pattern, hybrid 168, with a coupling ratio of 0.01927, divides the 0.7734 W in phase and provides 0.00149 W and 0.07885 W, respectively, to column of dipoles 1, and to hybrid 170. Hybrid 170, with a coupling ratio of 0.20633, divides the 0.07585 W in phase and provides 0.01565 W and 0.06020 W, respectively, to hybrids 172 and 174. Hybrid 172, with a coupling ratio of 0.30479, divides the 0.01565 W in phase and provides 0.00477 W and 0.01088 W, respectively to hybrids 182 and 180. While hybrid 174, with a coupling ratio of 0.37409, divides the 0.06020 W in phase and provides 0.02252 W and 0.03768 W, respectively to hybrids 178 and 176. Hybrid 182, with a coupling ratio of 0.40657, divides the 0.00477 W in phase and provides 0.00194 W and 0.00283 W, respectively, to columns of dipoles 2 and 3. Hybrid 180, with a coupling ratio of 0.39702, divides the 0.01088 W in phase and provides 0.00433 W and 0.00655 W, respectively, to columns of dipoles 4 and 5. Hybrid 178, with a coupling ratio of 0.42184, divides the 0.02252 W in phase and provides 0.00950 W and 0.01302 W, respectively, to columns of dipoles 6 and 7. While hybrid 176, with a coupling ratio of 0.44835; divides the 0.03768 W in phase and provides 0.01689 W and 0.02079 W, respectively, to columns of dipoles 8 and 9.

For the SLS pattern, hybrid 168, with its 0.01927 C. R., divides the −0.00165 W in phase and provides −0.00003 W and −0.00162 W, respectively, to column of dipoles 1 and hybrid 170. Hybrid 170, with its 0.20633 C. R., divides the −0.00162 W in phase and provides −0.00033 W and −0.00129 W, respectively, to hybrids 172 and 174. Hybrid 172, with its 0.30479 C. R., divides the −0.00033 W, in phase and provides −0.00010 W and −0.00023 W, respectively, to hybrids 182 and 180. While hybrid 174, with its 0.37409 C. R., divides the −0.00129 W in phase and provides −0.00048 W and −0.00081 W, respectively, to hybrids 178 and 176. Hybrid 182, with its 0.40657 C. R., divides the −0.00010 W in phase and provides −0.00004 W and −0.00006 W, respectively to columns of dipoles 2 and 3. Hybrid 180 with its 0.39792 C. R., drives the −0.00023 W in phase and provides −0.00009 W and −0.00014 W, respectively, to columns of dipoles 4 and 5. Hybrid 178, with its 0.42184 C. R., divides the −0.00048 W in phase and provides −0.00020 W and −0.00028 W, respectively to columns of dipoles 6 and 7. While, hybrid 176, with its 0.44835 C. R., divides the 0.00081 W in phase and provides −0.00036 W and −0.00045 W, respectively, to columns of dipoles 8 and 9.

Finally for the difference pattern, hybrid 168, with its 0.01927 C. R., divides the 0.20630 W in phase and provides 0.00398 W and 0.20232 W, respectively to column of dipoles 1 and to hybrid 170. Hybrid 170, with its 0.20633 C. R., divides the 0.20232 W in phase and provides 0.04174 W and 0.16058 W, respectively, to hybrids 172 and 174. Hybrid 172, with its 0.30479 C. R., divides the 0.04174 W in phase and provides 0.01272 W and 0.02902 W, respectively to hybrids 182 an 180. While hybrid 174 with its 0.37409 C. R., divides the 0.16058 W in phase and provides 0.06007 W and 0.10051 W, respectively to hybrids 178 and 176. Hybrid 182, with its 0.40657 C. R., divides the 0.01272 in phase and provides 0.00518 W and 0.00755 W, respectively, to columns of dipoles 2 and 3. Hybrid 180, with its 0.39792 C. R., divides the 0.02902 W in phase and provides 0.01154 W and 0.01747 W, respectively, to columns of dipoles 4 and 5. Hybrid 178, with its 0.42184 C. R., divides the 0.06007 W in phase and provides 0.02534 W and 0.03473 W, respectively, to columns of dipoles 6 and 7. While, hybrid 176, with its 0.44835 C. R., divides the 0.10051 W in phase and provides 0.04506 W and 0.05541 W, respectively, to column of dipoles 8 and 9.

Although only a single embodiment of the invention has been described, it will be apparent to a person skilled in the art that various modifications to the details of construction shown and described may be made without departing from the scope of the invention.

What is claimed is:

1. An array antenna comprising:

(a) an RF energy feed network having a plurality of input mechanisms for receiving RF power for a plurality of independent beams, a plurality of hybrid junctions selectively connected to the plurality of input mechanisms and a plurality of output mechanisms connected selectively to the plurality of hybrids, said plurality of hybrids selectively interconnected and having coupling ratios for maintaining independent modes of propagation and selectively dividing the power to provide RF energy at selected amplitudes to the output mechanisms, (b) a plurality of radiating elements divided into first and second halves connected to the plurality of hybrid output mechanisms for array excitation, and (c) said plurality of hybrids is divided into first, second and third portions, said first and second portions of hybrids operatively connected to the first and second halves of said radiating elements to form two independent, isolated, orthogonal antenna beams, one beam being an optimized low sidelobe sum beam ($\Sigma$) and the other beam being the algebraic difference between an independently, optimized difference beam and sum beam ($\Delta-\Sigma$), and said third portion of said hybrids operatively connected to the first and second portions of said hybrids to form an input power divider to the first and second portions of hybrids.

2. An array antenna according to claim 1 wherein the first and second halves of the plurality of radiating elements are further divided into first and second subsections and the first and second portions of hybrids of the feed network are divided into first and second subportions, said first and second subportions of hybrids operatively connected to the first and second subsections of radiating elements for providing substantially identical $\Sigma$ and $\Delta$ distributions to the first subsections of radiating elements and substantially different $\Sigma$ and $\Delta$ distributions to the second subsections of radiating elements whereby the algebraic difference between the $\Delta$ and $\Sigma$ distributions is substantially zero in the first subsections of radiating elements and the feed network is substantially simplified.

3. An array antenna according to claim 2 wherein the first subportions of hybrids which are connected to the first subsections of radiating elements for providing substantially zero $\Delta-\Sigma$ distribution have only $\tau$ input ports and the second subportions of hybrids which are connected to the second subsections of radiating elements have separate input ports for the $\Sigma$ distribution and the $\Delta-\Sigma$ distribution.

4. An array antenna according to claim 1 wherein the first and second halves of radiating elements are arranged in columns and include a center column between the first and second halves of columns of radiating elements, and a backfill column of radiating elements, and said input power divider has output terminals connected, respectively, to the center column of radiating elements and to the backfill column.

5. An array antenna according to claim 1 wherein the plurality of radiating elements are arranged in columns and include first and second subsections of first and second sections of columns of radiating elements, a center column of radiating elements separating the first and second sections, and a backfill column of radiating elements, and said plurality of hybrids form an input power divider and first, second, third and fourth power dividers, said input power divider has output terminals connected, respectively, to the backfill and center columns of radiating elements, first and second pairs $\Sigma$ output terminals for connection to the first, second, third and fourth power dividers, and a pair of $(\Delta-\Sigma)$ terminals for connection to the first and second power dividers, said first and second power dividers have $\Sigma$ and $(\Delta-\Sigma)$ terminals, connected, respectively, to the first pair of $\Sigma$ terminals and to the pair of $(\Delta-\Sigma)$ terminals of said input power divider and a plurality of power output terminals connected to first subsections of the first and second sections of columns of radiating elements, and the third and fourth power dividers have $\Sigma$ terminals connected to the second pair of $\Sigma$ output terminals of the input power divider and a plurality of output terminals connected to second subsections of the first and second sections of columns of radiating elements of the first and second sections.

6. An array antenna according to claim 5 wherein a $\Sigma$ channel includes a $\Sigma$ power input terminal mechanism, an input power terminal of the input power divider connected to the $\Sigma$ power input mechanism, selected portions of the plurality of hybrids of the input power divider connected to the first and second pairs of $\Sigma$ output terminals and center column of radiating element output terminal of the input power divider, the first pair of $\Sigma$ output terminals connected to the sum terminals of the first and second power dividers and the second pair of $\Sigma$ terminals connected to the $\Sigma$ terminals of the third and fourth power dividers and the center column of radiating elements terminal connected to the center column, and the plurality of outputs of the first, second, third, and fourth power dividers connected to the columns of radiating elements connected to the first and second sections.

7. An array antenna according to claim 5 wherein a difference ($\Delta$) channel includes a $\Delta$ power input terminal mechanism, an input power terminal of the input power divider connected to the $\Delta$ power input mechanism, selected portions of the plurality of the hybrids of the input power divider connected to the input terminal, first and second pairs of $\Sigma$ output terminals and a pair of $\Delta-\Sigma$ output terminals selectively connected to the plurality of hybrids of the input power divider; input terminals and $(\Delta-\Sigma)$ input terminals of the first and second power dividers connected, respectively, to the first pair of output terminals and the pair of $\Delta-\Sigma$ output terminals first and second power dividers; $\Sigma$ input terminals of the third and fourth power dividers connected to the second pair of $\Sigma$ output terminals of the input power divider; first and second portions of the plurality of hybrids of the first and second power dividers selectively coupled to the $\Sigma$ and $(\Delta-\Sigma)$ input terminals of the first and second power dividers and a plurality of output terminals, selectively, connected to first and second portions of hybrids of the first and second power dividers, and hybrids of the third and fourth power dividers selectively connected to the $\Sigma$ power input terminals of the third and fourth power dividers, and a plurality of output terminals selectively connected to the hybrids of the third and fourth power dividers; and first portions of the first and second sections of columns of radiating elements connected to the plurality of output terminals of the first and second power dividers, and second portions of the first and second sections of columns of radiating elements connected to the plurality of output terminals of the third and fourth power dividers.

8. An array antenna according to claim 5 wherein an SLS channel includes an omnidirectional power input mechanism, an input power terminal of the input power divider connected to the power input mechanism, a first portion of the plurality of hybrids of the input power divider selectively connected to the input power terminal, and first and second pairs of $\Sigma$ output terminals, and a center column terminal and a backfill column terminal; $\Sigma$ input terminals of first and second power dividers connected to the first pair of sum terminals of the input power dividers; $\Sigma$ terminals of the third and fourth power dividers connected to the second pair of $\Sigma$ output terminals of the input power divider; hybrids selectively connected, respectively, to the $\Sigma$ input terminals of the first and second power dividers and output terminals selectively connected to the hybrids of the first and second power dividers; hybrids selectively connected, respectively, to the $\Sigma$ input terminals of the third and fourth power dividers and output terminals selectively connected to the hybrids of the third and fourth power dividers; and first portions of the first and second sections of columns of radiating elements connected to the output terminals of the first and second power dividers and second portions of the first and second sections of columns of radiating elements connected to the output terminals of the third and fourth power dividers, a center column of radiating elements connected to the center column terminal of the input power divider and a backfill column connected to the backfill column terminal of the input power divider.

9. An array antenna comprising a plurality of columns of radiating elements and a feed network operatively connected to the columns of radiating elements, said radiating elements arranged in first and second sections with a center column therebetween and a backfill column therebehind, said feed network having a sum channel, a difference channel and a sidelobe suppression channel formed in common in an input power divider and first, second, third and fourth power dividers, said power dividers connected in a corporate arrangement for providing equal length paths of minimum length to the columns of radiating elements of the first and second sections, said power dividers comprising a plurality of hybrids having preselected coupling ratios and interconnections: to form the input power divider with input ports for sum, difference, and SLS RF power, and output ports for sum, difference, difference minus sum, and SLS amplitudes for the first and second power dividers, and sum, difference, and SLS amplitudes to the third and fourth power dividers, to form the first and second power dividers with input ports connected to selected output ports of the input power divider for forming tapered sum and SLS amplitudes, and tapered difference power by selectively combining the difference minus sum amplitudes to the difference amplitudes as a control for the difference amplitudes to provide power for a difference pattern excitation which is independent of the amplitude for the sum and SLS pattern excitations and output ports for a preselected number of columns of radiating elements of each of the first and second sections, and to form the third and fourth power dividers with input ports connected to selected output ports of the input power divider for forming substantially independent tapered sum, difference, and SLS amplitude excitations, and output ports for the remaining columns of radiating elements of the first and second sections, said columns of radiating elements responsive to said sum, difference, and SLS amplitude excitations of the columns of radiating elements to form sum, difference and SLS beam patterns.

10. An array antenna according to claim 9 wherein the first and second sections each include 17 columns of radiating elements and the input power divider includes eight hybrids, said hybrids for the sum channel including a sum pattern input terminal connected to the sum input port of a first hybrid, said first hybrid for selectively dividing the power and providing first and second amplitudes through its output ports, respectively, to the center (SLS) column, and to the sum input port of a second hybrid, said second hybrid for dividing the second amplitude selectively and providing third and fourth amplitudes through its output ports, respectively, to the sum input ports of third and fourth hybrids, said third and fourth hybrids for dividing equally and in phase, respectively, the third and fourth amplitudes and providing the equal amplitudes, respectively, to sum output terminals for the first and second power dividers, and to the output terminals for the third and fourth power dividers; said difference channel including the third and fourth hybrids of the sum channel and a difference pattern input terminal connected to a fifth hybrid, said fifth hybrid for selectively dividing the difference input power and providing first and second amplitudes through its output ports, respectively, to the sum input port of a sixth hybrid and to the difference input port of a seventh hybrid, said sixth hybrid for selectively dividing the power and providing third and fourth amplitudes to the difference input ports of the third and fourth hybrids, said third, fourth, and seventh hybrids for dividing the third, fourth and second amplitudes equally and providing through their output ports equal amplitudes in phase and out-of-phase, respectively, to the sum output ports, difference minus sum output ports for the sum and difference minus sum input terminals of the first and second power dividers, and outputs for the input terminals of the third and fourth power dividers; and said SLS channel includes the hybrids of the sum channel and in addition a SLS input terminal connected to the sum input port of an eighth hybrid; said eighth hybrid for selectively dividing the SLS power and providing first and second amplitudes, respectively, to the backfill column and to the difference port of the first hybrid of the sum channel, said first hybrid for selectively dividing the second amplitude into first and second amplitudes and providing through its output ports the first amplitude in phase to the center column and the second amplitude out-of-phase through the sum channel which provides preselected outputs to the output terminals for the first and second power dividers and to the output terminals for the third and fourth power dividers.

11. An array antenna according to claim 9 wherein the first and second power dividers are multiple-way power dividers.

12. An array antenna according to claim 11 wherein each of the multiple-way power dividers include thirteen hybrids, said power for the sum and SLS channels being out of phase, said sum and SLS channels are common and independent and include an input terminal connected to a first hybrid, said first hybrid for selectively dividing the power into first and second amplitudes connected, respectively, to second and third hybrids, said second hybrid for selectively dividing the first amplitude and providing third and fourth amplitudes, respectively, to the sum input ports of fourth and fifth hybrids, said third hybrid for selectively dividing the second amplitude and providing through its output ports fifth and sixth amplitudes, respectively, to sixth and seventh hybrids, said fourth, fifth, sixth and seventh hybrids for selectively dividing the third, fourth, fifth and sixth amplitudes and providing seventh through fourteenth amplitudes, respectively, to selected columns of radiating elements 10–17; said difference channel includes the first seven hybrids of the sum and sidelobe suppression channels and a control circuit comprising a $\Delta-\Sigma$ input terminal connected to an eighth hybrid, said eighth hybrid for selectively dividing the control power and providing first and second amplitudes, respectively, through its output ports to the difference port of the fifth hybrid of the sum channel and to the sum port of a ninth hybrid, said ninth hybrid for selectively dividing the second amplitude and providing third and fourth amplitudes, respectively, to the difference port of the first hybrid of the sum channel and to the sum port of a tenth hybrid, said tenth hybrid for selectively dividing the fourth amplitude and providing fifth and sixth amplitudes through its output ports, respectively, to the difference port of the sixth hybrid of the sum channel and to the sum port of an eleventh hybrid, said eleventh hybrid for selectively dividing the sixth amplitude and providing seventh and eighth amplitudes through its output ports, respectively, to the difference port of the second hybrid of the sum channel and to the sum port of a twelfth hybrid, said twelfth hybrid for selectively dividing the eighth amplitude and providing through its output ports ninth and tenth amplitudes, respectively, to the difference ports of the fourth and thirteenth hybrids, said thirteenth hybrid for selectively dividing the tenth amplitude and providing through its output ports eleventh and twelfth amplitudes of the third and seventh hybrids of the sum channel, said first hybrid dividing selectively the third amplitude applied at its difference port and providing a first control amplitude in phase and a second control amplitude out of phase at its outputs, and dividing selectively and in phase the difference pattern power applied at its sum input port into first and second amplitudes at its output terminals said first and second control amplitudes adding and subtracting, respectively, to the first and second amplitudes of the difference pattern and providing first and second adjusted voltages to the sum input terminals of the second and third hybrids, said second hybrid selectively dividing the seventh amplitude applied at its sum port to provide second and third difference pattern amplitudes at its output ports where they add and subtract to provide third and fourth adjusted difference pattern amplitudes to the sum inputs of the fourth and fifth hybrids of the sum channel, said third hybrid selectively dividing the eleventh amplitude applied at its difference port and the second adjusted difference pattern amplitude applied at its sum port and provides, respectively, fifth and sixth control amplitudes and fifth and sixth difference pattern amplitudes at its output ports where they add and subtract to provide fifth and sixth adjusted difference pattern amplitudes to the sixth and seventh hybrids of the sum circuit, and the fourth, fifth, sixth and seventh hybrids divide selectively the ninth, first, fifth and twelfth control amplitudes applied at their difference ports and the third, fourth, fifth and sixth adjusted difference pattern amplitudes applied at their sum ports and provide amplitudes thereof at their output ports which add and subtract to provide tapered difference pattern excitation amplitudes for columns of radiating elements 10 through 17.

13. An array antenna according to claim 9 wherein the third and fourth power dividers are multiple-way power dividers.

14. An array antenna according to claim 13 wherein each multiple-way power divider comprises eight hybrids, said power for the sum, difference, and SLS channels being substantially independent of each other and in common include an input terminal, a first hybrid connected to the input terminal, said first hybrid for selectively dividing the input power for the sum, difference and SLS patterns and providing first amplitudes thereof to the first column of radiating elements and the second portions to a second hybrid, said second hybrid for dividing the second portions selectively and providing third and fourth amplitudes thereof, respectively, to third and fourth hybrids, said third hybrid for dividing the third amplitude selectively and providing fifth and sixth amplitudes to fifth and sixth hybrids, said fourth hybrid for dividing the fourth amplitude selectively and providing seventh and eighth amplitudes, respectively to seventh and eighth hybrids, and said fifth, sixth, seventh, and eighth hybrids for dividing the fifth, sixth, seventh and eighth amplitudes selectively for columns of radiating elements two through nine.

* * * * *